United States Patent [19]

Chiyoda et al.

[11] 4,379,762

[45] Apr. 12, 1983

[54] METHOD OF PRODUCING PICTURE TUBE COATING COMPOSITIONS

[75] Inventors: Hironobu Chiyoda, Kokubunji; Hisayuki Yamazaki, Kashiwa; Reiichiro Takabe, Kamagaya, all of Japan

[73] Assignee: Hitachi Powdered Metals Company, Ltd., Chiba, Japan

[21] Appl. No.: 133,952

[22] Filed: Mar. 25, 1980

[30] Foreign Application Priority Data

Sep. 14, 1979 [JP] Japan ..... 54-117381

[51] Int. Cl.[3] ..... H01B 1/06

[52] U.S. Cl. ..... 252/507; 252/506; 313/450; 313/479; 313/480; 427/64

[58] Field of Search ..... 252/506, 507, 518, 520; 313/450, 479, 480; 427/64, 68, 162, 204, 205, 230, 233, 376 A, 105, 106; 106/307, 308 R, 308 B

[56] References Cited

U.S. PATENT DOCUMENTS

| | | | |
|---|---|---|---|
| 3,947,608 | 3/1976 | Duinker et al. | 427/64 |
| 3,959,686 | 5/1976 | Davis et al. | 313/479 X |
| 4,018,717 | 4/1977 | Francel et al. | 313/479 |
| 4,041,347 | 4/1977 | Deal et al. | 1252/506 X |
| 4,052,641 | 10/1977 | Dominick et al. | 313/479 |
| 4,163,919 | 8/1979 | Speigel | 313/479 |
| 4,249,107 | 2/1981 | Kelichouski | 313/479 |

*Primary Examiner*—J. L. Barr

*Attorney, Agent, or Firm*—Antonelli, Terry & Wands

[57] ABSTRACT

A method of producing a graphite-based conductive coating composition to be applied to the interior wall of a color picture (cathode-ray) tube, which method comprises the steps of preparing a mixed solution of electroconductive materials by mixing graphite particles, a metal oxide and a surface treating agent with water, producing an electroconductive powder by instantaneously drying said mixed solution, and mixing said electroconductive powder with a silicate and a dispersant in water and stirring the mixture. Said metal oxide, which is a component of said mixed solution, is preferably titanium oxide and the like and said surface treating agent is preferably silicon oxide. It is also desirable that said mixed solution of electroconductive materials be dried instantaneously by spray drying.

3 Claims, 11 Drawing Figures

METHOD OF PRODUCING PICTURE TUBE COATING COMPOSITIONS

BACKGROUND OF THE INVENTION

1. Field of the Invention

This invention relates to a method of producing a graphite-based conductive coating composition to be applied to the interior wall of a color picture tube.

2. Description of the Prior Art

Generally, the interior wall of the funnel portion of a color picture (cathode-ray) tube is coated with an electroconductive film for the purpose of accelerating the electron beams by applying a high voltage or for the purpose of preventing the decline of color contrast by capturing the secondary electrons emitted from the electrodes such as shadow mask fluorescent screen.

Such an electroconductive coating film needs to be firmly attached to the wall surface so that it won't peel off in use. It is also essential that this coating film be provided with a prescribed resistivity to minimize arcing.

Heretofore, these electroconductive coating films have been formed by applying a coating composition containing powdered electroconductive materials on the interior wall of the funnel portion and then subjecting the coated wall to a heat treatment. The coating composition used was prepared by dispersing a metal oxide such as titanium oxide and a small quantity of graphite in a silicate solution, the so-called water glass, in the presence of a dispersant.

However, this conventional coating composition has a serious defect in that it is very poor in dispersion stability. This is due to the fact that, although titanium oxide is dispersed uniformly in the silicate solution immediately after mixing, said compound tends to give rise to a phenomenon of aggregation several minutes to several hours after mixing and is liable to separate from the silicate solution. Use of a coating composition with nonuniformly dispersed titanium oxide does not allow formation of a fast and secure electroconductive coating film and also results in wide variations in resistivity, making it impossible to provide a stable high resistivity.

In order to prevent separation of the components of the coating material, a continuous and strong mixing and stirring operation was required in the coating work, so that the coating workability was poor. Hence it was impossible to perform the coating operation quickly and with high efficiency.

SUMMARY OF THE INVENTION

The present invention is intended to eliminate the inherent defects, such as mentioned above, in conventional coating compositions to be applied to the interior wall of television picture tubes, and the essence of the invention lies in a series of steps for producing a coating composition for picture tube walls, said coating composition allowing titanium oxide and the like to remain permanently and uniformly dispersed in the silicate solution after preparation of the composition.

As a result of extensive research on the subject, the present inventors found that dispersion stability of the coating composition is markedly improved when the composition is produced from a novel process according to which, unlike the conventional method where all the component materials are suspended at one time, first the fine particles of graphite and a metal oxide, which are the electroconductive materials, and a surface treating agent are mixed in water, then this mixed solution is dried, preferably by instantaneous drying, to form an electroconductive composite powder, and finally this powder is mixed with the remaining component materials, a silicate and a dispersant, in water and stirred to obtain a desired coating composition. Further studies and experiments have led to the finding that best results are obtained when said drying is accomplished instantaneously by using a spray dryer.

Thus it is an object of this invention to provide an improved method of producing a coating composition to be applied to the interior wall of a picture tube, said coating composition being characterized by the fact that the effective components thereof won't aggregate or be separated, but will remain dispersed uniformly in the silicate solution for a long time after preparation of the composition.

Another object of this invention is to provide a method of producing a coating composition having said properties, said method consisting of simple steps.

Still another object of this invention is to provide a method of producing said coating composition wherein said series of steps can be accomplished without use of specific machine or apparatus.

A further object of this invention is to provide a method of producing said coating composition according to which said series of production steps can be accomplished without using any specific or expensive component materials or additives.

Other objects and advantageous features of this invention will be easily understood upon review of the following detailed description of the invention taken in conjunction with the accompanying drawings and photographs.

BRIEF DESCRIPTION OF THE ACCOMPANYING DRAWINGS

The invention is described in detail hereinbelow with reference to the accompanying drawings and photographs which include a diagrammatic illustration of an electroconductive powder made according to the method of this invention, a microphotograph of this powder, a microphotograph of the final coating composition, a microphotograph of a conventional tray-dried electroconductive powder shown here for the sake of comparison, microphotographs of a coating composition according to this invention and of conventional coating compositions, and characteristic graphs illustrating in a comparative way, the properties of a coating composition according to this invention and those of conventional coating compositions.

DETAILED DESCRIPTION OF THE PREFERRED EMBODIMENTS

The preferred embodiments of the invention will now be described in detail.

First, graphite is crushed by a ball mill into particles with a diameter of 2 to 3 microns, and these graphite particles are then mixed with a metal oxide, preferably titanium oxide, and with a surface treating agent, preferably silicon oxide, in water to produce a mixed solution of electroconductive materials. This mixed solution is then dried instantaneously by using a spray dryer. The spray dryer used in the drying step is of the type which is provided with a spray nozzle and a powder discharge port in the lower part of the conical chamber and a heater in the upper part of said chamber. When said mixed solution of electroconductive materials is sprayed upwardly from the spray nozzle, the liquid is atomized and rises up in the heater, by which the liquid particles are heated to a temperature of 50°-350° C. and thereby dried in a very short period of time. Such instantaneous drying is accomplished in an interval of several seconds to one minute at longest. The dried powder drops along the interior wall of the chamber and amasses at the discharge port. By such instantaneous drying of the mixed solution of electroconductive materials, there is obtained an electroconductive powder such as diagrammatically shown in FIG. 1.

Figure 1:
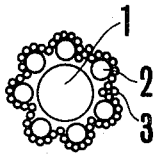
FIG. 1 is a diagrammatic sketch of an electroconductive powder formed by the method according to this invention of producing a coating composition for picture tube walls.

Referring more closely to FIG. 1, reference numeral 1 indicates a negatively charged graphite particle with a diameter of approximately 2 to 3 microns, reference numeral 2 shows positively charged titanium oxide particles and the like with a diameter of approximately 0.5-0.1 micron, and reference numeral 3 denotes negatively charged silicon oxide particles with a diameter of approximately 0.007-0.008 microns. Thus, this drawing schematically illustrates the structure of the electroconductive powder in which titanium oxide and the like is adsorbed around each graphite particle 1 and silicon oxide is adsorbed around each titanium oxide particle.

Figure 2:
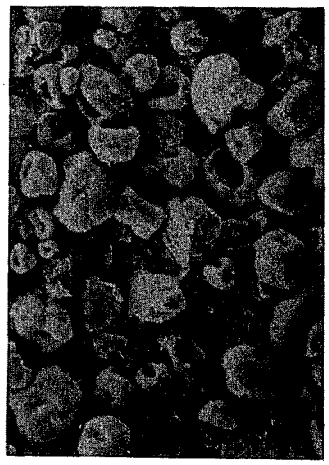
FIG. 2 is a microphotograph (magnified 200 times) of the electroconductive powder shown diagrammatically in FIG. 1.
Figure 3:
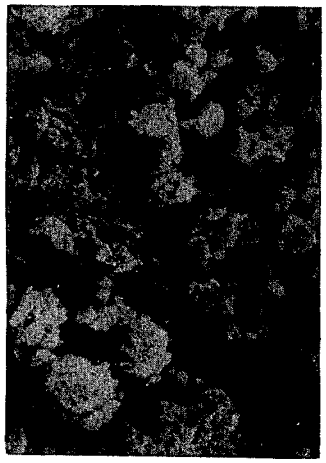
FIG. 3 is a microphotograph (magnified 200 times) of a conventional electroconductive powder which has been dried gradually by a tray dryer.

FIG. 2 is a microphotograph (magnified 200 times) of the electroconductive powder thus formed, and FIG. 3 is a similar microphotograph of an electroconductive powder which has been dried gradually by a conventional tray dryer, the latter microphotograph being shown for the sake of comparison.

Said electroconductive powder is then mixed in water together with a silicate, such as potassium silicate, and a dispersant and the mixture is stirred sufficiently to obtain the desired coating composition.

In a coating composition produced according to the method of this invention, the electroconductive powder stays dispersed uniformly in the silicate solution. The silicate solution is usually negatively charged because of the alkali salts contained therein. In conventional coating compositions of this type, the electroconductive powder mixed in the negatively charged silicate solution carries positive charges, giving rise to aggregation of the electroconductive powder particles due to the attraction between the powder particles and the medium, resulting in separation of the electroconductive powder from the medium. However, in a coating composition produced according to the method of this invention, since the electroconductive powder is negatively charged in the solution as shown in FIG. 1, there exists electrostatic repulsion between the electroconductive powder particles themselves, allowing dispersion of the powder particles in the solution.

Figure 4:
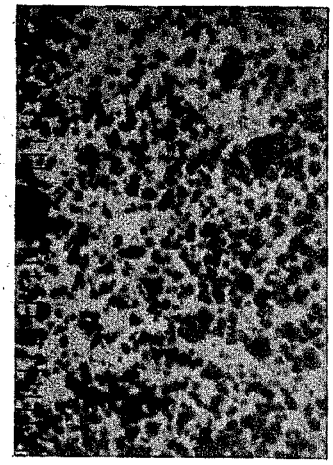
FIG. 4 is a microphotograph (magnified 758 times) of a coating composition produced according to the method of this invention.
Figure 5:
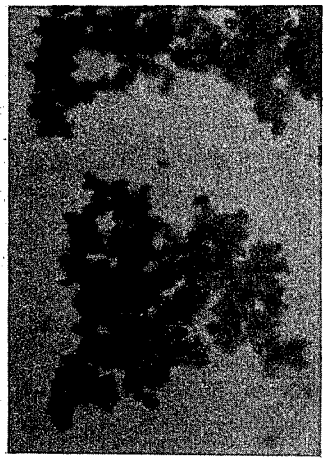
FIG. 5 is a microphotograph (magnified 758 times) of a conventional coating composition.

FIG. 4 is a microphotograph (magnified 758 time) of a coating composition according to this invention, from which it will be seen that the electroconductive powder particles are dispersed stably in the aqueous solution. FIG. 5 is a similar microphotograph of a conventional tray-dried coating composition, where it will be noted that the powder particles are perfectly aggregated.

Figure 6:
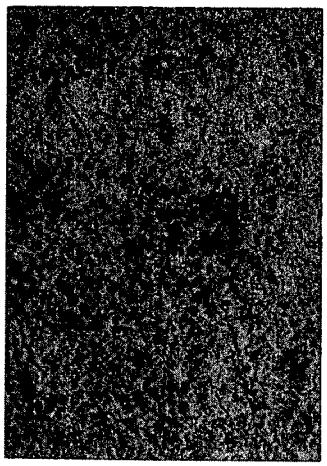
FIG. 6 is an SEM photograph (magnified 400 times) showing the distribution of titanium oxide in a coating film formed according to the method of this invention.
Figure 7:
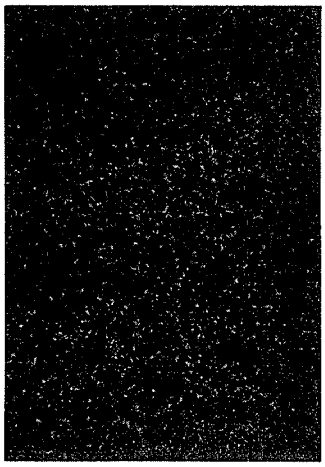
FIG. 7 is an analytical microphotograph (magnified 400 times) of an EMPA titanium plane in the coating film shown in FIG. 6.

FIG. 6 is an SEM photograph (magnified 400 times) showing the distribution of titanium oxide and the like in a coating film formed according to the method of this invention, and FIG. 7 is an analytical microphotograph (magnified 400 times) of an EPMA titanium plane. It will be seen that the titanium oxide and the like is dispersed uniformly.

Figure 8:
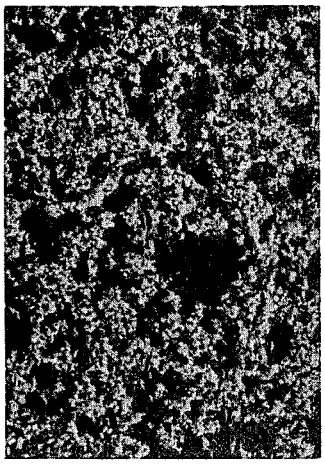
FIG. 8 is an SEM photograph (magnified 400 times) showing the distribution of titanium oxide in a coating film formed according to conventional methods.
Figure 9:
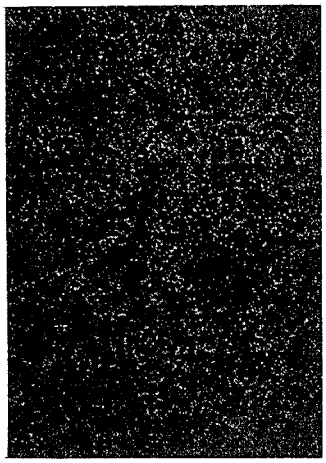
FIG. 9 is an analytical microphotograph (magnified 400 times) of an EPMA titanium plane in the conventional coating composition shown in FIG. 8.

FIG. 8 is an SEM photograph (magnified 400 times) showing the distribution of titanium oxide in a coating film formed by using a conventional tray-dried coating composition, and is shown here for the sake of comparison. FIG. 9 is an analytical microphotograph (magnified 400 times) of an EPMA titanium plane. In these microphotographs, are as devoid of titanium oxide may be noted.

The coating composition according to this invention is further described below concerning its properties.

Figure 10:
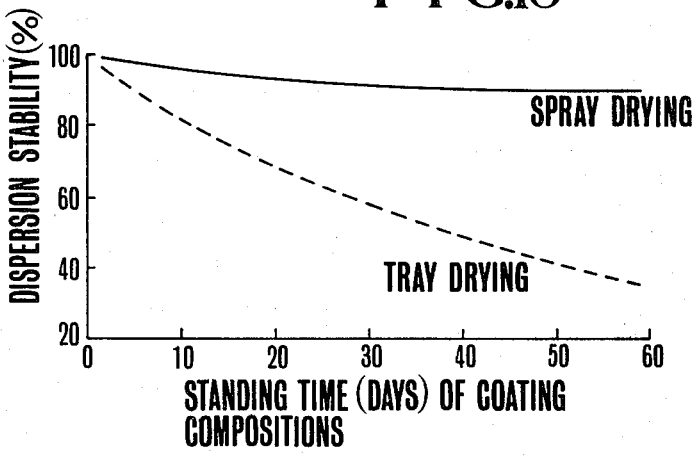
FIG. 10 is a characteristic graph illustrating the relationship between the standing time, in days, of the coating composition and its dispersion stability for the cases of spray drying according to this invention and of conventional tray drying.

FIG. 10 is a graph showing the relationship between the standing time of the coating composition and its dispersion stability as observed in tests conducted on a coating composition which had undergone instantaneous drying according to this invention as well as a conventional tray-dried coating composition. It will be seen that the coating composition according to this invention is little deteriorated in dispersion stability and substantially maintains its initial stability level over many days as it is left standing. The term "dispersion stability" is taken to mean the ratio (expressed by wt. %) between the portion of the electroconductive powder which was perfectly dispersed in the aqueous solution and the portion of said powder which was aggregated.

Figure 11:
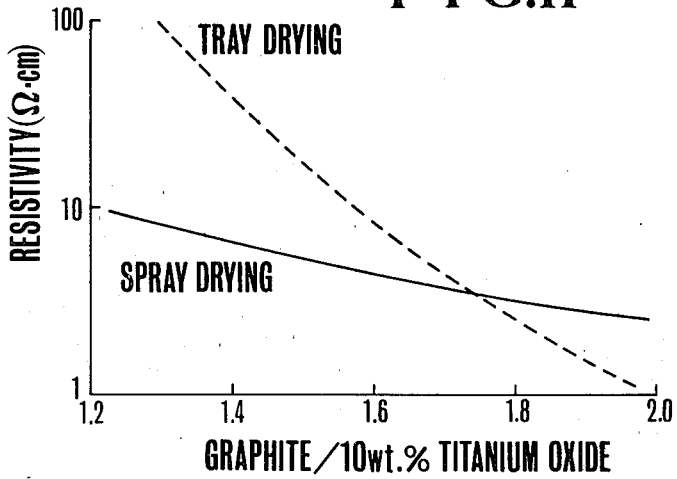
FIG. 11 is a characteristic graph illustrating the relationship between the blending ratio of graphite particles to titanium oxide and resistivity for the cases of spray drying according to this invention and of conventional tray drying.

FIG. 11 is a graph showing the relation between the blending ratio of graphite particles to titanium oxide and resistivity, where the number of parts by weight of graphite particles mixed with 10 parts by weight of titanium oxide is plotted along the abscissa.

In conventional coating compositions the specific resistance varies greatly as the graphite blending ratio changes, so that it is difficult to obtain a desired resistivity; but in the case of a coating composition produced according to the method of this invention, there is a wider range of choice for adjustment of the graphite blending ratio because of the low gradient of the characteristic curve, allowing a desired resistivity with simple preparation. Further, addition of titanium oxide allows a stable high resistivity.

When a coating composition according to this invention is applied to the interior wall of the funnel portion of a picture tube, there is no need to stir the coating composition since the electroconductive powder is dispersed uniformly. Thus the coating workability is greatly improved and the formed electroconductive coating film is strong and homogenous. Further, since the electroconductive coating film is provided with a prescribed stable resistivity, arcing is inhibited and hence the effect of such sparking on the television circuits is minimized. Moreover, such a coating film can prevent picture noise or misoperation of the electronic tuners and can also prolong the life of the picture tube.

In the above-described preferred embodiments of this invention, instantaneous drying of the mixed solution of electroconductive materials was accomplished by using a spray dryer, but it is possible to employ other suitable drying systems if they are capable of producing the same drying effect as a spray dryer.

As described above, by using a coating composition produced according to the method of this invention, it is possible to easily form an electroconductive coating film with a prescribed stable resistivity firmly on the interior wall of a television picture tube since the electroconductive component materials remain dispersed uniformly for days after preparation of the coating composition.

While the present invention has been described by way of some preferred embodiments thereof, it will be apparent that many and various changes and modifications can suitably be made in the described arrangements of the invention without departing from the spirit and scope of the claims of the invention.

What is claimed is:

1. A method of producing a graphite-based coating composition to be applied to the interior wall of a picture tube, which comprises:

mixing graphite particles having a diameter of about 2 to 3 microns, titanium oxide with a particle diameter of about 0.5 to 1.0 micron and silicon oxide having a particle diameter of about 0.007 to 0.008 microns, in water to prepare an aqueous mixture of the electroconductive particles;

spray drying said aqueous mixture to form an electroconductive powder; and mixing said electroconductive powder with an alkali metal silicate and a dispersant in water and thoroughly agitating the resulting mixture.

2. A method according to claim 1, wherein said electroconductive powder comprises a material wherein positively charged titanium oxide particles are adsorbed around each negatively charged graphite particle and negative charged particles of silicon oxide are adsorbed around each of the titanium oxide particles.

3. A method according to claim 1, wherein said alkali metal silicate is potassium silicate.

* * * * *